US007279835B2

(12) United States Patent
Chang

(10) Patent No.: US 7,279,835 B2
(45) Date of Patent: Oct. 9, 2007

(54) PLASMA DISPLAY PANEL AND FABRICATING METHOD THEREOF

(75) Inventor: Sung Ho Chang, Kumi (KR)

(73) Assignee: LG Electronics Inc., Seoul (KR)

( * ) Notice: Subject to any disclaimer, the term of this patent is extended or adjusted under 35 U.S.C. 154(b) by 54 days.

(21) Appl. No.: 10/740,560

(22) Filed: Dec. 22, 2003

(65) Prior Publication Data

US 2004/0178728 A1 Sep. 16, 2004

(30) Foreign Application Priority Data

Dec. 27, 2002 (KR) ..... 10-2002-0084782

(51) Int. Cl.
*H01J 17/49* (2006.01)

(52) U.S. Cl. ..... 313/582

(58) Field of Classification Search ..... 313/582–587
See application file for complete search history.

(56) References Cited

U.S. PATENT DOCUMENTS 6,184,621 B1 * 2/2001 Horiuchi et al. ..... 313/586
2003/0107318 A1 * 6/2003 Aoki et al. ..... 313/582

FOREIGN PATENT DOCUMENTS

KR 1020000002444 1/2000

OTHER PUBLICATIONS

Korean Office Action dated Nov. 26, 2004.

* cited by examiner

*Primary Examiner*—Karabi Guharay
*Assistant Examiner*—Anthony Canning
(74) *Attorney, Agent, or Firm*—Ked & Associates, LLP

(57) ABSTRACT

A plasma display panel that prevents color mixture between adjacent cells is provided. The plasma display panel includes a plurality of discharge cells defined by a corresponding plurality of barrier ribs, and a phosphor layer formed on the bottom surface of the discharge cells and side surfaces of the barrier ribs. A ratio of the thickness of the phosphor layer formed on the side surface of the barrier ribs to the thickness of the phosphor layer formed on the bottom surface of the discharge is between approximately 0.8 and 1.3. A phosphor layer formed in this manner provides improved emission characteristics, and allows for a simplified, more cost effective manufacturing process.

18 Claims, 11 Drawing Sheets

PLASMA DISPLAY PANEL AND FABRICATING METHOD THEREOF

This application claims the benefit of the Korean Patent Application No. P2002-24782 filed on Dec. 27, 2002, which is hereby incorporated by reference.

BACKGROUND OF THE INVENTION

1. Field of the Invention

The present invention relates to a plasma display panel and a manufacturing method thereof, and more particularly to a plasma display panel and a manufacturing method thereof that is adaptive for preventing color mixture between adjacent cells.

2. Description of the Related Art

Generally, a plasma display panel (PDP) excites a phosphor material to emit light by using an ultraviolet ray of 147 nm generated when discharging an inactive mixture gas such as He+Xe, Ne+Xe or He+Ne+Xe, thereby displaying a picture including characters or graphics. Such a PDP is easy to be made into a thin-film and large-dimension type. Moreover, the PDP provides highly improved picture quality owing to a recent technical development. Especially, a three-electrode AC surface discharge PDP has an advantage in low voltage drive and long life span because wall charges are accumulated on a surface upon discharge and electrodes are protected from sputtering generated by the discharge.

Referring to FIG. 1, a discharge cell of a conventional three-electrode AC surface-discharge PDP includes a scan electrode Y and a sustain electrode Z provided on an upper substrate 10, and an address electrode X provided on a lower substrate 18. Each of the scan electrode Y and the sustain electrode Z includes a transparent electrode 12Y and 12Z, respectively, each having a metal bus electrode 13Y and 13Z, respectively, formed on one side edge of the corresponding transparent electrode. The metal bus electrode 13Y, 13Z has narrower line width than the transparent electrode 12Y, 12Z.

The transparent electrode 12Y, 12Z is formed of Indium Tin Oxide (ITO) on the upper substrate 10. The metal bus electrode 13Y, 13Z is generally formed of metal such as Chrome Cr on the transparent electrode 12Y, 12Z and it acts to reduce voltage drop caused by the transparent electrode 12Y, 12Z, resistance of which is high. An upper dielectric layer 14 and a protective film 16 is deposited on the upper substrate 10 where the scan electrode Y and the sustain electrode Z are formed in parallel. The wall charges generated upon plasma discharge are accumulated in the upper dielectric layer 14. The protective film 16 prevents the damage of the upper dielectric layer 14 caused by the sputtering generated upon plasma discharge and also increases emission efficiency of secondary electrons. The protective film 16 is generally made of Magnesium Oxide MgO.

A lower dielectric layer 22 and barrier ribs 24 are formed on the lower substrate 18 provided with the address electrode X and a phosphorous layer 26 is formed on the surface of the barrier ribs 24 and the lower dielectric layer 22. The address electrode X is formed to cross the scan electrode Y and the sustain electrode Z. The barrier ribs 24 are formed in stripe or lattice shape to prevent the ultraviolet ray and the visible ray, which are generated by discharge, from leaking to the adjacent discharge cells. Inactive mixture gas is injected into a discharge space provided among the upper substrate 10, the lower substrate 18 and the barrier ribs 24.

The phosphorous layer 26 is made of a type of phosphor material excited by the ultraviolet ray emitted by vacuum ultraviolet ray VUV, and is divided into red phosphor, green phosphor and blue phosphor in accordance with the wavelength of the emitted light. Normally, the red phosphor is (YGd)BO3:Eu3+, the green phosphor is Zn2SiO4:Mn2+, and the blue phosphor is BaMgAl10O17:Eu2+. Such red, green and blue phosphor is printed inside the PDP in screen printing method while it is in paste state.

FIGS. 2A to 2C are views representing a prior art phosphor printing method.

Referring to FIG. 2A, firstly a phosphor paste 30 is prepared by mixing the phosphor material R, G and B, resin and solvent together. Herein, the resin is high molecular Ethyl Cellulose, the solvent is a solution, which has a boiling point higher than 100° C., such as N-methyl Pyrrolidone, Ethyleneglycol, 2-Butoxy ethoxy ethanol, cellosolve and so on.

More specifically describing, the phosphor should be prepared to be in paste state in order to print the phosphor. That is, the phosphor material is mixed with the resin and the solvent in order that the phosphor can be inserted into the discharge space 39 located inside the PDP. Herein, the resin is high molecular Ethyl Cellulose, the molecular weight of which is high. If the high molecular resin is mixed with the phosphor material, the phosphor material can have a viscosity which is required for printing.

The phosphor paste 30 is spread on a mask 34 as in FIG. 2A in order to print the phosphor in the discharge space 39. The mask 34 includes a printing area 36 and a shielding area 38 as in FIG. 3. The printing area 36 is formed in mesh to allow the phosphor paste 30 to pass through to the discharge space 39. For this, the printing area 36 is located to overlap the discharge space 39. The shielding area 38 is formed to overlap the barrier ribs 24 to prevent the phosphor paste 30 from being supplied to the barrier ribs 24.

After the phosphor paste 30 is spread over the mask 34, a squeeze 32 is moved in one direction and applies a designated pressure to the phosphor paste 30, accordingly the phosphor paste 30 is passed through the printing area 36 of the mask 34 to the discharge space 39. In fact, the phosphor paste 30 that passed by the printing area 36 is printed in the discharge are 39 inside the PDP as in FIG. 2B.

However, such a prior art phosphor paste 30 is mixed with the high molecular resin, i.e., it has high viscosity, thus a lot of the phosphor paste 40 remain at the border area of the shielding area 38 and the printing area 36. In this way, the remaining phosphor paste 40 flows into the upper part of the barrier ribs 24 and the adjacent discharge cells as in FIG. 2C when the mask 34 is eliminated. Herein, the remaining phosphor paste 40 that flew into the upper part of the barrier ribs 24 and the adjacent discharge cells causes color mixture when driving PDP, thereby deteriorating the display quality.

Therefore, in the end, the phosphor paste 40 remaining at the mask 34 is eliminated by use of a cleaning tape. However, even though the phosphor paste 40 remaining at the mask 34 is removed by use of a cleaning tape, plenty of the remaining phosphor paste 40 flows into the barrier ribs 24 and the adjacent discharge cell. In addition, because the phosphor paste 30 with high viscosity is used in prior art, a lot of phosphor paste 40 remains at the mask 34, thus the cleaning tape must be used more frequently. However, if the cleaning tape is frequently used, there is a problem in that its process time and manufacturing cost increase. In addition, the phosphor paste 30 is manufactured in use of the high molecular resin. However, the phosphor including the high molecular resin has a disadvantage in a short life span according to the experiment.

SUMMARY OF THE INVENTION

Accordingly, it is an object of the present invention to provide a plasma display panel and a manufacturing method thereof that is adaptive for preventing color mixture between adjacent cells.

In order to achieve these and other objects of the invention, a plasma display panel according to an aspect of the present invention includes a plurality of discharge cells; barrier ribs to partition off the discharge cells; and a phosphor layer formed on the bottom surface of the discharge cells and the side surface of the barrier ribs, wherein if the thickness of the phosphor layer formed on the side surface of the barrier ribs is D1 and the thickness of the phosphor layer formed on the bottom surface of the discharge cell is D2, the value of D1/D2 ranges from 0.8 to 1.3.

The phosphor layer is formed by coating and firing phosphor paste with its viscosity-elasticity ratio in the range of 68-73.

The D1 and the D2 range from 15 μm to 25 μm.

The value of the D1/D2 is about 1.

The phosphor layer is formed by coating and firing phosphor paste which includes a mixed resin by mixing a low molecular resin with a high molecular resin.

A manufacturing method of a plasma display panel according to another aspect of present invention includes the steps of: providing a mixed resin by mixing a high molecular resin with a low molecular resin; providing a phosphor paste by mixing a phosphor material a solvent into the mixed resin; and forming a phosphor layer by coating and firing the phosphor paste.

The mixed resin includes a low molecular resin of 20%~50% and a high molecular resin of 50%~80%.

In the method, the ratio of viscosity and elasticity of the phosphor paste in the range of 68-78.

In the method, the composition of the phosphor paste is a mixed resin of 8~15 wt %, a phosphor material of 40~50 wt % and a solvent of 40~50 wt %.

In the method, the phosphor layer formed on the side surface of barrier ribs and the bottom surface of a discharge cell, and if the thickness of the phosphor layer formed on the side surface of the barrier ribs is D1 and the thickness of the phosphor layer formed on the bottom surface of the discharge cell is D2, the value of D1/D2 ranges from 0.8 to 1.3.

In the method, the D1 and the D2 range from 15 μm to 25 μm.

In the method, the value of the D1/D2 is about 1.

In the method, Cellulose family derivative is selected as the high molecular resin and the low molecular resin.

In the method, any one of Ethyl Cellulose, Ethylhydroxyethyl Cellulose, Hydroxyalkylmethyl Cellulose and Dihydroxypropyl Cellulose is selected as the high molecular resin and the low molecular resin.

In the method, a high molecular Ethyl Cellulose resin with a molecular weight value in the range of 100,000-120,000 as the high molecular resin.

In the method, a low molecular Ethyl Cellulose resin with a molecular weight value in the range of 50,000-60,000 as the low molecular resin.

In the method, any one of Acrylamide, Diacetone Acrylamide and Vinyl Pyrrolidinone is selected as the high molecular resin and the low molecular resin.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

With reference to FIGS. 4 to 7, embodiments of the present invention will be explained as follows.

Figure 1:
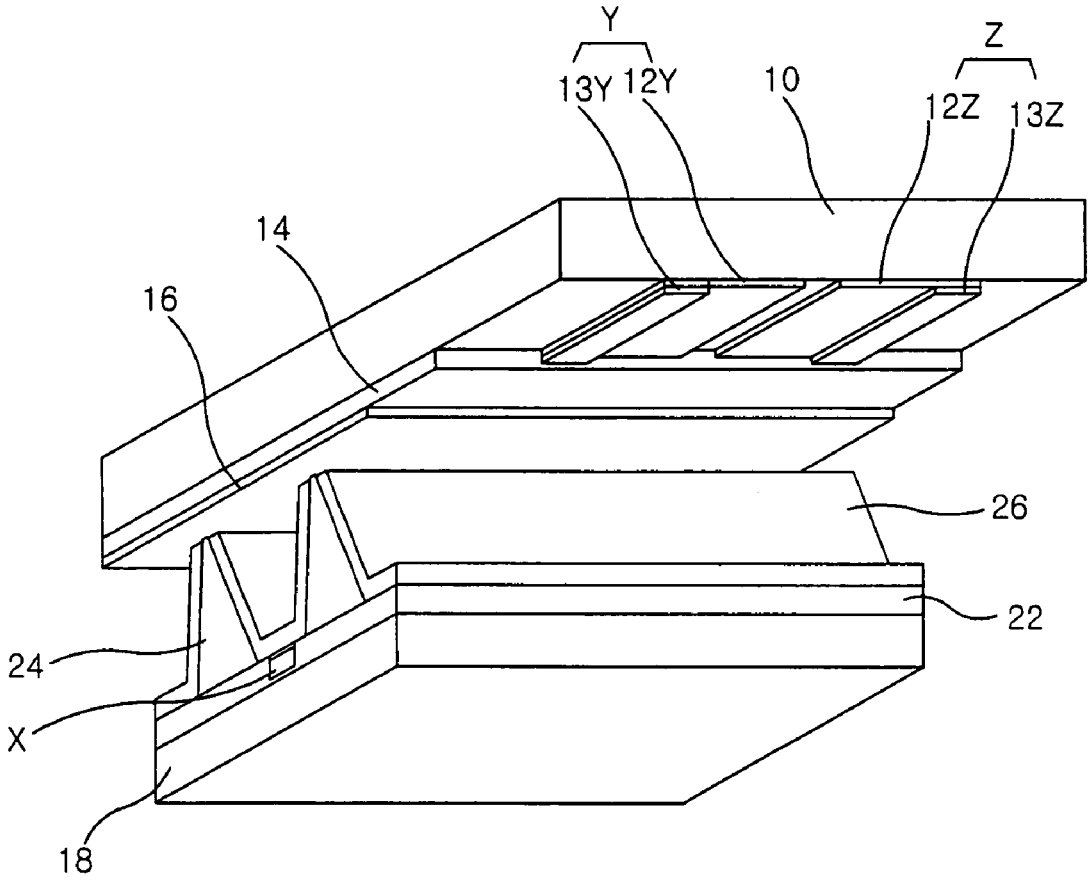
FIG. 1 RELATED ART
FIG. 1 is a perspective view representing a discharge cell structure of a prior art three-electrode AC surface discharge plasma display panel.
Figure 2A:
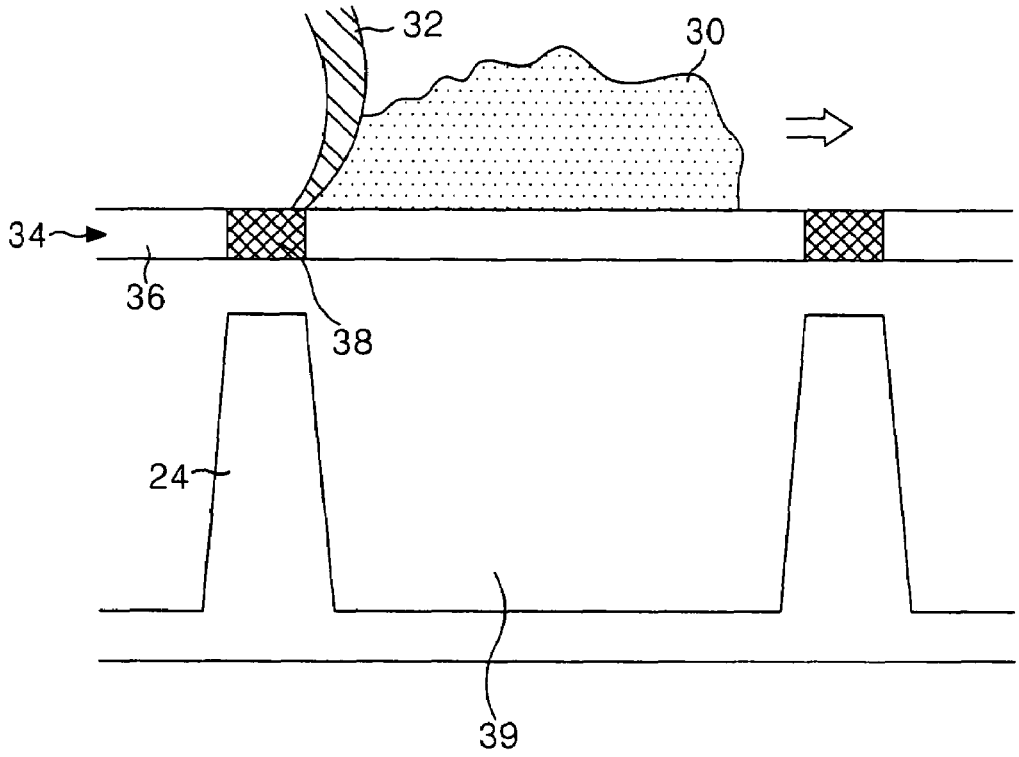
FIG.2A RELATED ART
FIGS. 2A to 2C are views representing a prior art phosphor printing method.
Figure 2B:
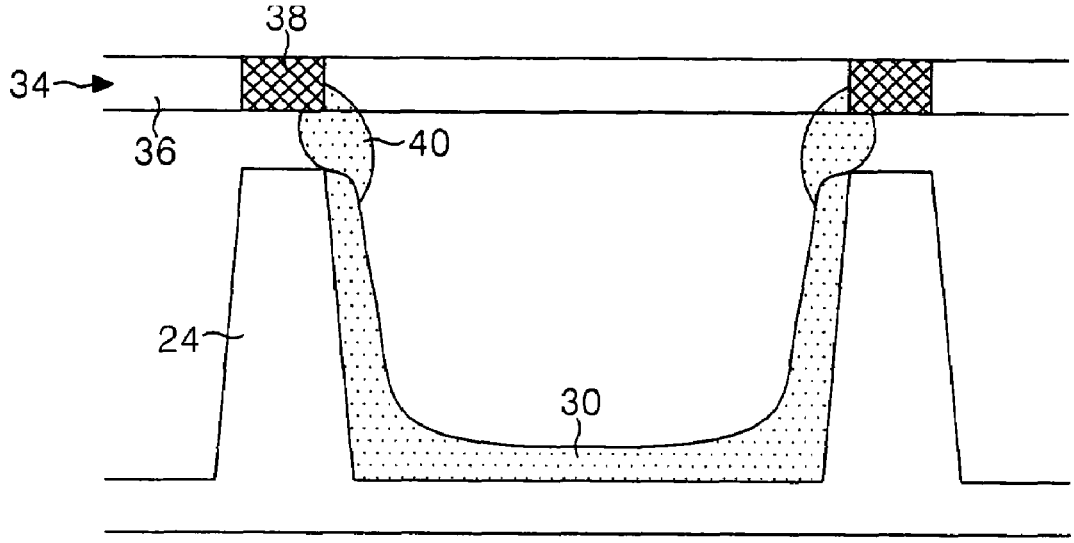
FIG.2B RELATED ART
Figure 2C:
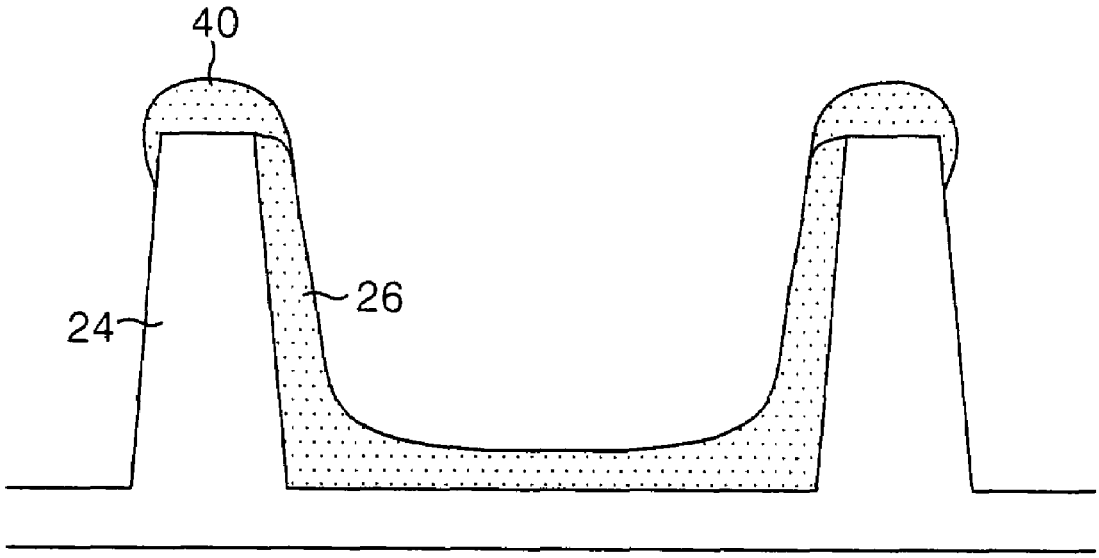
FIG.2C RELATED ART
Figure 3:
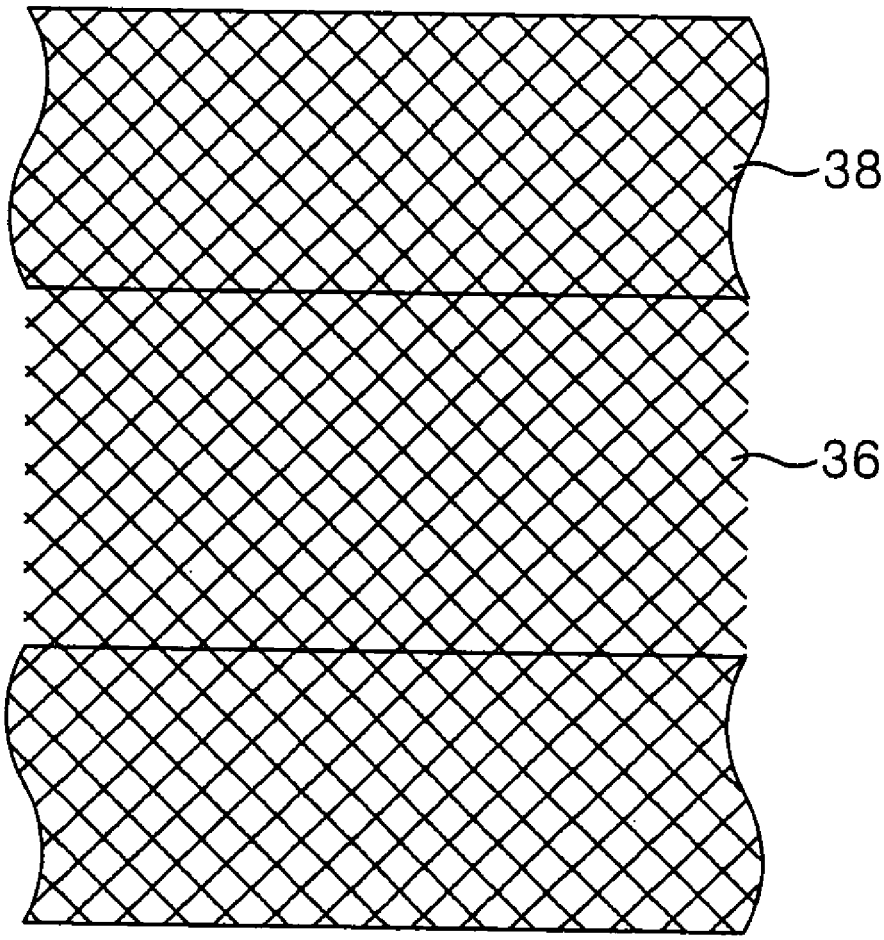
FIG.3 RELATED ART
FIG. 3 is a view representing a mask shown in FIGS. 2A to 2C in detail.
Figure 4:
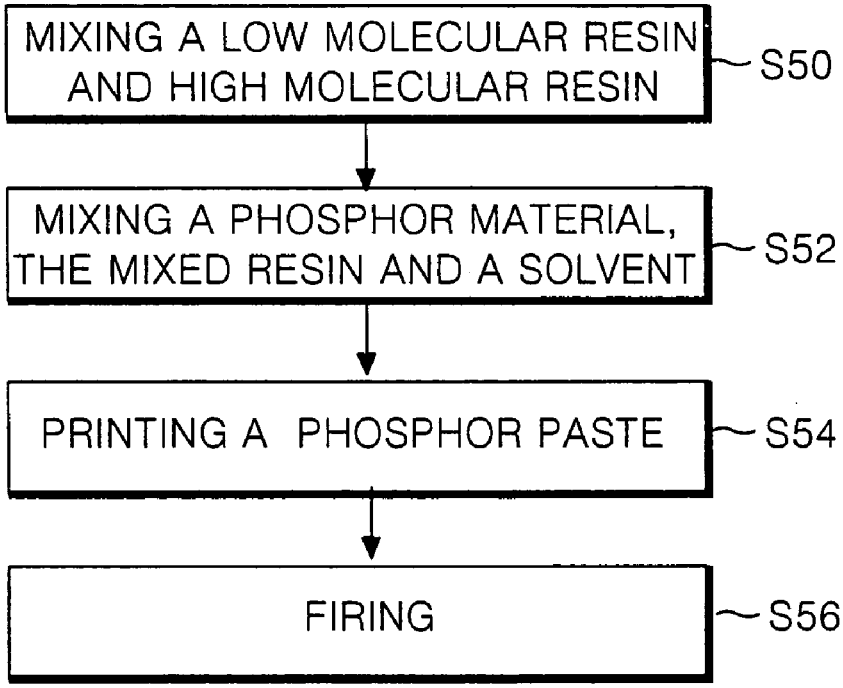
FIG. 4 is a view representing a manufacturing method of a plasma display panel according to an embodiment of the present invention.

FIG. 4 is a view representing a manufacturing method of a plasma display panel according to an embodiment of the present invention.

Referring to FIG. 4, in a manufacturing method of phosphor paste according to an embodiment of the present invention, firstly, a low and high molecular resin is mixed to make a compound resin. (S50) The high molecular resin has a long chain, thus it has high viscosity and low elasticity, i.e., its recovering power is low in correspondence to stress. On the contrary, the low molecular resin has a short chain, thus it has low viscosity and high elasticity, i.e., its recovering power is high in correspondence to stress. In this way, if the high molecular resin with high viscosity and low elasticity is mixed with the low molecular resin with low viscosity and high elasticity, the phosphor paste with desired elasticity and viscosity may be generated.

On the other hand, the resin used in the step S50 can be set variously. For example, the used resin might be any one of cellulose family derivatives such as Ethyl Cellulose, Ethylhydroxyethyl Cellulose, Hydroxyalkylmethyl Cellulose and Dihydroxypropyl Cellulose. Furthermore, the resin can be Acrylamide, Diacetone Arylamide or Vinyl Pyrrolidinone.

The embodiment of the present invention will be described assuming that Ethyl Cellulose is used as the resin for the sake of convenience of explanation. Instep S50, the low molecular Ethyl Cellulose resin (molecular weight 50,000 to 60,000) is mixed with the high molecular Ethyl Cellulose resin (molecular weight 100,000 to 120,000) to make a mixed resin. Herein, the mixing rate of the low molecular resin and the high molecular resin is set to be 20% to 50% of the low molecular resin and 80% to 50% of the high molecular resin.

Figure 5:
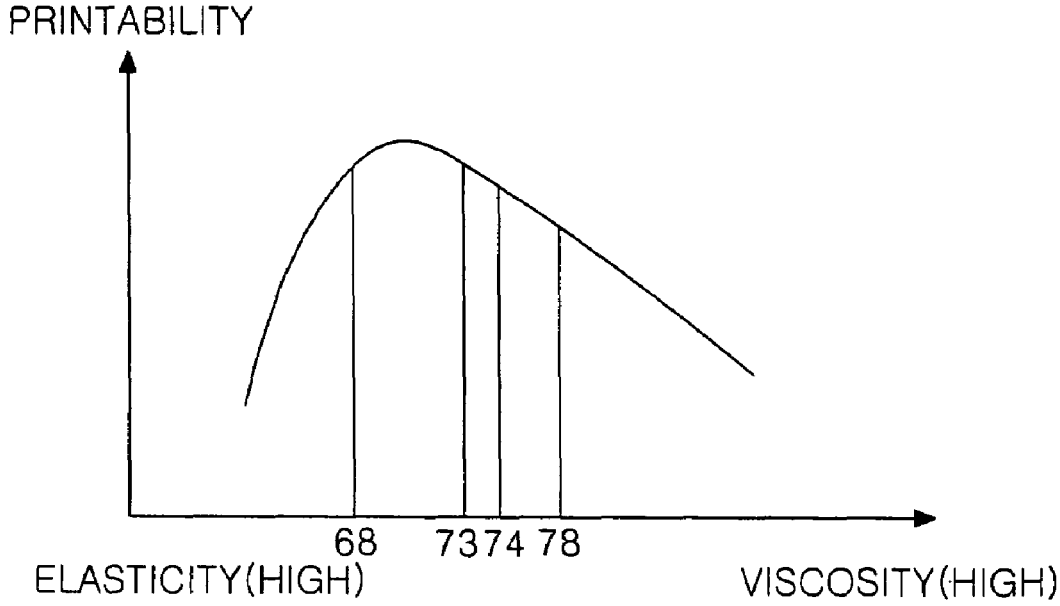
FIG. 5 is a graph representing the viscosity-elasticity ratio of a phosphor paste made in the method of FIG. 4.

If the mixed resin of 20% to 50% of the low molecular resin and 80% to 50% of the high molecular resin is made in the step S50, the viscosity and elasticity ratio of the phosphor paste to be made in the step S52 can be positioned in the range of 68-73 as in FIG. 5. That is, the mixed resin made in the step S50 is utilized to make the phosphor paste with its viscosity-elasticity ratio in the range of 68-73 in the step S52. Herein, if the viscosity-elasticity ratio is sustained in the range of 68-73, the phosphor paste is shown to have high printability in its experience.

Figure 6A:
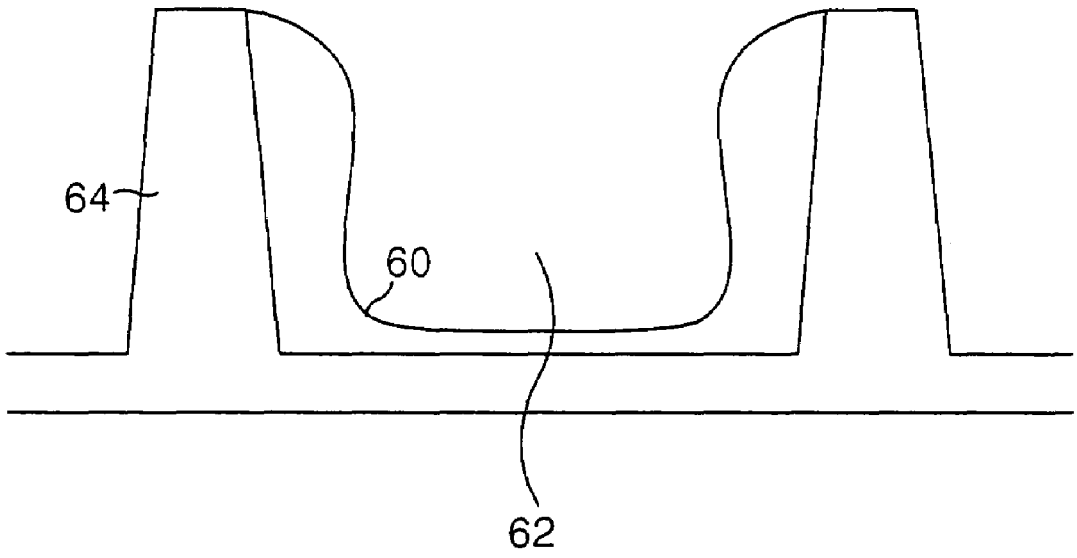
FIG. 6A to 6C are a view representing the thickness of the phosphor formed at a discharge cell in response to the viscosity-elasticity ratio of the phosphor paste.

These will be described more specifically by referring to FIGS. 6A to 6C. If the phosphor 60 is made in use of the phosphor paste with its viscosity-elasticity ratio in the range of 60-65 as in FIG. 6A, the phosphor 60 is formed in barrier ribs 64 to have high thickness. In other words, the phosphor paste with its viscosity-elasticity ratio in the range of 60-65 almost does not flow, accordingly the phosphor 60 formed in the barrier ribs 64 becomes thicker than the phosphor 60 formed in the lower part of the discharge space 62, i.e., on the lower part of dielectric). In fact, if the phosphor 60 is made by use of the phosphor paste with the viscosity-elasticity ratio in the range of 60-65, the thickness of the phosphor 60 formed in the barrier ribs 64 is about 25 μm, and the thickness of the phosphor 60 formed at the lower part of the discharge space 62 is about 10 μm to 12 μm. That is, if the phosphor 60 is formed by use of the phosphor paste with its viscosity-elasticity ratio in the range of 60-65, the thickness value (side/lower part) of the phosphor 60 ranges from 2.1 to 2.5. In other words, if the phosphor 60 is formed by use of the phosphor paste with its viscosity-elasticity ratio in the range of 60-65, barrier ribs cannot be formed evenly within the discharge space 62 so that it is not possible to generate a light with evenness and high brightness in general within the discharge space 62, i.e., discharge cell.

Figure 6B:
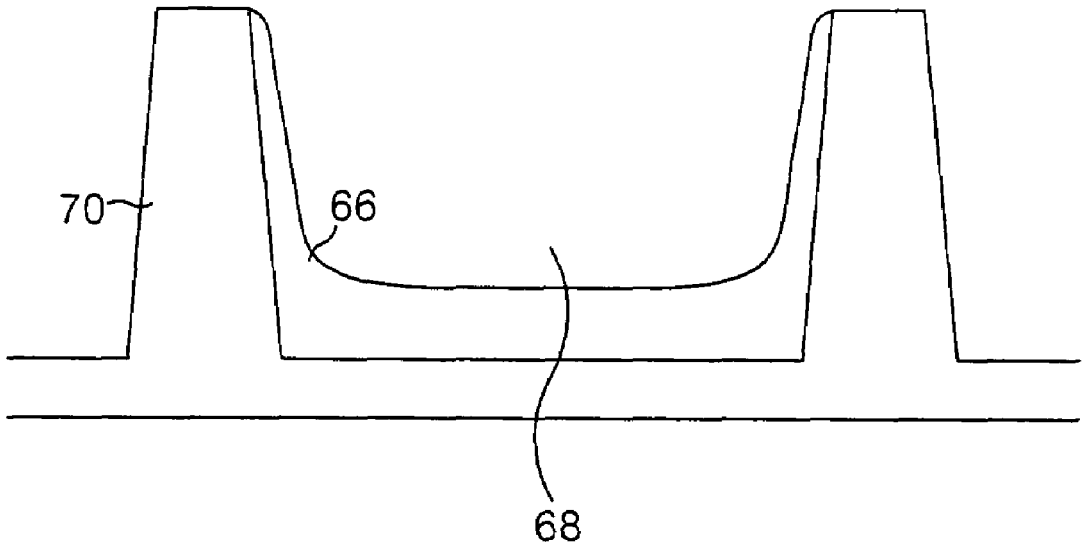

On the other hand, if the phosphor 66 is made in use of the phosphor paste with its viscosity-elasticity ratio in the range of 75-80 as in FIG. 6B, the phosphor 66 is formed in the lower part of the discharge space 68 to have high thickness. In other words, the phosphor paste with its viscosity-elasticity ratio in the range of 75-80 has high liquidity, thus the phosphor 66 formed in the lower part of the discharge space 68 becomes thicker than the phosphor 66 formed in the barrier ribs 70. In fact, if the phosphor 66 is made by use of the phosphor paste with the viscosity-elasticity ratio in the range of 75-80, the thickness of the phosphor 66 formed in the barrier ribs 70 is about 15 μm, and the thickness of the phosphor 66 formed at the lower part of the discharge space 68 is about 25 μm. That is, if the phosphor 66 is formed by use of the phosphor paste with its viscosity-elasticity ratio in the range of 75-80, the thickness value (side/lower part) of the phosphor 66 is set to 0.6. In other words, if the phosphor 66 is formed by use of the phosphor paste with its viscosity-elasticity ratio in the range of 75-80, barrier ribs cannot be formed evenly within the discharge space 68 so that it is not possible to generate a light with evenness and high brightness in general within the discharge space 68, i.e., discharge cell.

Figure 6C:
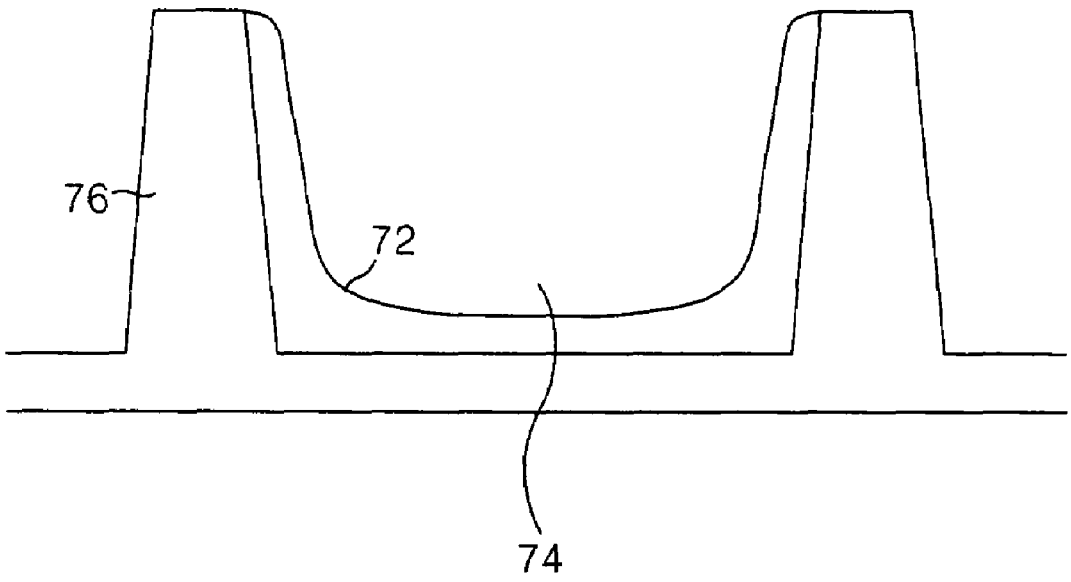

In comparison to these, if the phosphor 72 is made in use of the phosphor paste with its viscosity-elasticity ratio in the range of 68-73 as in FIG. 6C, the phosphor 72 is formed within the discharge space 74 to have even height. In fact, if the phosphor 72 is made by use of the phosphor paste with the viscosity-elasticity ratio in the range of 68-73, the thickness of the phosphor 72 formed in the barrier ribs 70 is about 20 μm, and the thickness of the phosphor 72 formed at the lower part of the discharge space 74 is about 15 μm to 25 μm. That is, if the phosphor 72 is formed by use of the phosphor paste with its viscosity-elasticity ratio in the range of 68-73, the thickness value (side/lower part) of the phosphor 72 ranges from 0.8 to 1.3. Herein, the thickness ration of the phosphor 72 is preferably set to about 1 so that the phosphor 72 is distributed evenly inside the cell.

In other words, if the phosphor 72 is formed by use of the phosphor paste with its viscosity-elasticity ratio in the range of 68-73, barrier ribs can be formed evenly within the discharge space 74 so that it is possible to generate a light with evenness and high brightness in general within the discharge space 74, i.e., discharge cell.

On the other hand, after the mixed resin is made in the step S50, the phosphor material R, G and B, the mixed resin and the solvent are mixed together to make the phosphor. (S52) Herein, the ratio of the phosphor material, the mixed resin and the solvent is set to be 40~50 wt %, 8~15 wt % and 40~50 wt % respectively.

Normally, the red phosphor is (YGd)BO3:Eu3+, the green phosphor is Zn2SiO4:Mn2+, and the blue phosphor is BaMgAl10017:Eu2+. In addition, the solvent is a solution, which has a boiling point higher than 100° C., such as N-methyl Pyrrolidone, Ethyleneglycol, 2-Butoxy ethoxy ethanol, cellosolve and so on.

Figure 7:
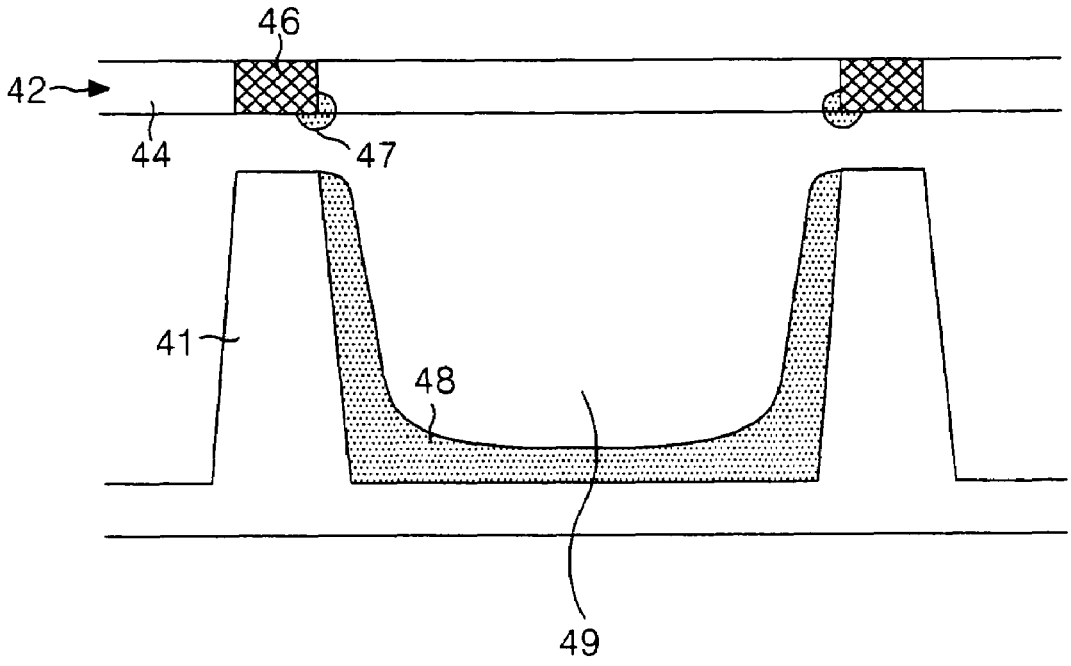
FIG. 7 is a view representing the remaining amount of the phosphor paste at a mask, wherein the phosphor paste is made in the manufacturing method of FIG. 4.

After the phosphor paste being made in the step S52, the phosphor paste 48 is formed on the discharge space 49 of the PDP as shown in FIG. 7. (S54) At this moment, the phosphor paste 48 of the present invention has higher elasticity than prior art, thus less phosphor paste 47 remains at the border part of the printing area 44 and the shielding area 46. In this way, if less amount of phosphor paste 47 remains at the mask 42, the phosphor paste 47 remaining upon removal of the mask 42 is not stuck to the barrier ribs 41 and the adjacent cells, thereby preventing the color mixture of the PDP. In addition, since less amount of the phosphor paste 47 remains at the mask 42, the number of usage of cleaning tape can be reduced, and accordingly the process time and manufacturing cost decrease. After the phosphor paste 48 being printed in the step S54, the phosphor paste 48 is fired to form the phosphor layer 72 in the discharge space 49. (S56)

As described above, according to the manufacturing method of the plasma display panel of the present invention, the high molecular resin is mixed with the low molecular resin to make the phosphor paste with its viscosity-elasticity ratio in the range of 68-73. In this way, the phosphor paste with the viscosity-elasticity ratio in the range of 68-73 is shown to have high printability in the experiment, thus the amount of the phosphor paste remaining at the mask can be minimized, and accordingly the color mixture of the plasma display panel can be prevented. In addition, it is possible to reduce the number of usage of cleaning tape that is used for reducing the phosphor paste remaining at the mask, and accordingly the manufacturing cost and the process time can be reduced. Also, if the phosphor is formed by use of the phosphor paste with its viscosity-elasticity ratio in the range of 68-73, it is possible to fabricate the phosphor with even thickness in the discharge cell, i.e., the discharge space. In this way, if the phosphor with even thickness is formed in the discharge cell, light is evenly generated in the entire discharge cell.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a plurality of discharge cells;

a plurality of barrier ribs configured to partition off the plurality of discharge cells; and a phosphor layer formed on a bottom surface of each of the plurality of discharge cells and side surfaces of the plurality of barrier ribs, wherein if a thickness of the phosphor layer formed on the side surface of a barrier rib at a position which is half of a height of the respective barrier rib is D1, and a thickness of the phosphor layer formed on the bottom surface of a corresponding discharge cell at a position which is halfway between adjacent barrier ribs which partition the corresponding discharge cell is D2, a value of D1/D2 is greater than or equal to 0.8 and less than 1.0, or greater than 1.0 and less than or equal to 1.3.

2. The plasma display panel according to claim 1, wherein the phosphor layer comprises a phosphor paste.

3. The plasma display panel according to claim 2, wherein the phosphor paste has a viscosity-elasticity ratio of between 68 and 73.

4. The plasma display panel according to claim 2, wherein the phosphor paste comprises a mixed resin which includes a low molecular resin and a high molecular resin.

5. The plasma display panel according to claim 4, wherein the phosphor paste comprises 40 to 50 wt % of at least one of a red, green and blue phosphor material, 8 to 15 wt % of mixed resin, and 40 to 50 wt % of a solvent.

6. The plasma display panel according to claim 4, wherein the mixed resin comprises 20 to 30 wt % low molecular resin, and 50 to 80 wt % high molecular resin.

7. The plasma display panel according to claim 1, wherein Dl and D2 are each between 15 μm and 25 μm.

8. The plasma display panel according to claim 1, wherein each of the plurality of barrier ribs has a substantially trapezoidal cross section.

9. The plasma display panel according to claim 1, wherein a value of D1/D2 is greater than 1.2 and less than 1.3.

10. The plasma display panel according to claim 1, wherein D1 and D2 are each between 15 μm and 25 μm.

11. The plasma display panel according to claim 1, wherein each of the plurality of barrier ribs has a substantially trapezoidal cross section.

12. The plasma display panel according to claim 1, wherein the phosphor layer comprises a phosphor paste.

13. The plasma display panel according to claim 12, wherein the phosphor paste has a viscosity-elasticity ratio of between approximately 68 and 73.

14. The plasma display panel according to claim 12, wherein the phosphor paste comprises 40 to 50 wt % of at least one of a red, green and blue phosphor material, 8 to 15 wt % of mixed resin, and 40 to 50 wt % of a solvent.

15. The plasma display panel according to claim 12, wherein the phosphor paste comprises a mixed resin which includes a low molecular resin and a high molecular resin.

16. The plasma display panel according to claim 15, wherein the mixed resin comprises 20 to 50 wt % low molecular resin and 50 to 80 wt % high molecular resin.

17. The plasma display panel according to claim 1, wherein the plurality of barrier ribs are formed on a dielectric layer, and wherein the dielectric layer is provided on a substrate, and wherein at least one electrode is provided in the dielectric layer.

18. The plasma display panel according to claim 17, wherein the phosphor layer does not include an electrode embedded therein.

* * * * *